US006470768B2

(12) United States Patent
Kato et al.

(10) Patent No.: US 6,470,768 B2
(45) Date of Patent: Oct. 29, 2002

(54) ACCELERATOR WITH ATTACHMENT OF PEDAL ARM

(75) Inventors: Yasunari Kato, Toyoake; Takahiro Tamura, Toyohashi, both of (JP)

(73) Assignee: Denso Corporation, Kariya (JP)

( * ) Notice: Subject to any disclaimer, the term of this patent is extended or adjusted under 35 U.S.C. 154(b) by 8 days.

(21) Appl. No.: 09/739,787

(22) Filed: Dec. 20, 2000

(65) Prior Publication Data

US 2001/0004853 A1 Jun. 28, 2001

(30) Foreign Application Priority Data

Dec. 28, 1999 (JP) ..... 11-373491

(51) Int. Cl.[7] ..... G05G 1/14
(52) U.S. Cl. ..... 74/513; 74/512; 74/560
(58) Field of Search ..... 74/512, 513, 560, 74/514; 180/271

(56) References Cited

U.S. PATENT DOCUMENTS 5,768,946 A * 6/1998 Fromer et al. ..... 74/514
6,019,016 A * 2/2000 Takagi et al. ..... 123/399
6,330,838 B1 * 12/2001 Kalsi ..... 200/61.89
2001/0007206 A1 * 7/2001 Kato et al. ..... 73/118.1

FOREIGN PATENT DOCUMENTS

JP 10-959 1/1998
JP 10-287147 10/1998

* cited by examiner

*Primary Examiner*—David A. Bucci
*Assistant Examiner*—Julie K. Smith
(74) *Attorney, Agent, or Firm*—Nixon & Vanderhye P.C.

(57) ABSTRACT

In an accelerator, an acceleration rotor made of resin is rotatably supported in a support shaft, one end portion of a pedal arm is connected to an acceleration pedal, and the other end portion of the pedal arm is attached to attachment portions of the acceleration rotor. The attachment portions are provided in the acceleration rotor to be separated in a rotation direction of the acceleration rotor. For example, the attachment portions are a press-fitting portion, into which a top end part of the other end portion of the pedal arm is press-fitted, and an insertion portion, into which a bending part of the other end portion of the pedal arm is inserted. Thus, the pedal arm can be accurately readily attached to the resinous acceleration rotor to be only rotated around the support shaft of the acceleration rotor.

18 Claims, 6 Drawing Sheets

ACCELERATOR WITH ATTACHMENT OF PEDAL ARM

CROSS-REFERENCE TO RELATED APPLICATION

This application is related to and claims priority from Japanese Patent Application No. Hei. 11-373491 filed on Dec. 28, 1999, the contents of which are hereby incorporated by reference.

BACKGROUND OF THE INVENTION

1. Field of the Invention

The present invention relates to an accelerator in which a pedal arm is attached to a resinous acceleration rotor supported rotatably in a support member.

2. Description of Related Art

In a conventional accelerator, an acceleration rotor is mechanically connected to a throttle device by a wire and the like, so that the degree of throttle opening is controlled by stepping on an acceleration pedal attached to a pedal arm of the accelerator. On the other hand, in an accelerator described in JP-A-10-287147, an acceleration opening sensor is provided, and the degree of throttle opening is electrically controlled based on detection signals from the acceleration opening sensor. In such accelerator, the acceleration rotor can be made of resin to reduce its weight. However, in this case, it is necessary to have an attachment structure for accurately attaching the pedal arm to the acceleration rotor.

SUMMARY OF THE INVENTION

In view of the foregoing problems, it is an object of the present invention to provide an accelerator which can be readily manufactured while having a reduced weight.

It is another object of the present invention to provide an accelerator in which a pedal arm can be readily accurately attached to a resinous acceleration rotor.

It is a further another object of the present invention to provide an accelerator which prevents a resinous acceleration rotor from being damaged.

According to the present invention, in an accelerator, an acceleration rotor made of resin has plural attachment portions separated from each other in a rotation direction of the acceleration rotor. An acceleration pedal for performing an acceleration operation is attached to one end portion of the pedal arm, and the other end portion of the pedal arm is attached to the plural attachment portions of the acceleration rotor. The other end portion of the pedal arm is bent to be attached to the plural attachment portions in such a manner that a virtual line connecting both approximate centers of any two attachment portions crosses with the pedal arm at least at one of any two attachment portions. Accordingly, even when a force is applied to the pedal arm in a direction for rotating the pedal arm around a rotation axis different from a rotation shaft of the acceleration rotor due to stepping on the acceleration pedal, the pedal arm does not rotate. Thus, acceleration operation of the accelerator can be accurately performed. Further, because the pedal arm is attached to plural attachment portions of the acceleration rotor separated from each other in the rotation direction, additional force applied from the pedal arm to the acceleration rotor can be dispersed. Therefore, it can prevent the resinous acceleration rotor from being damaged due to stepping on the acceleration pedal. In addition, because the acceleration rotor is made of resin, the acceleration rotor can be readily formed into various shapes, and the weight of the acceleration rotor can be reduced.

Preferably, the plural attachment portions of the acceleration rotor at least have a first attachment part to which a top end part of the other end portion of the pedal arm is attached, and a second attachment part different from the first attachment part. Because the top end part of the other end portion of the pedal arm is press-fitted into the first attachment part, the pedal arm can be readily attached to the acceleration rotor.

More preferably, the other end portion of the pedal arm has an insertion part at a position different from the top end part, and the insertion part of the other end portion of the pedal arm is inserted into the second attachment part of the acceleration rotor. Therefore, the pedal arm can be readily accurately attached to the acceleration rotor without using a fastening member.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

A first preferred embodiment of the present invention will be described with reference to FIGS. 1–6. In the first embodiment, the present invention is typically applied to an accelerator 10 shown in FIG. 1, which is not connected to a throttle device by a wire or the like. The accelerator 10 has an acceleration opening degree sensor 40 (acceleration sensor), and an engine control device (ECU) controls a throttle opening degree of the throttle device based on an acceleration opening degree detected by the acceleration opening degree sensor 40.

Figure 5:
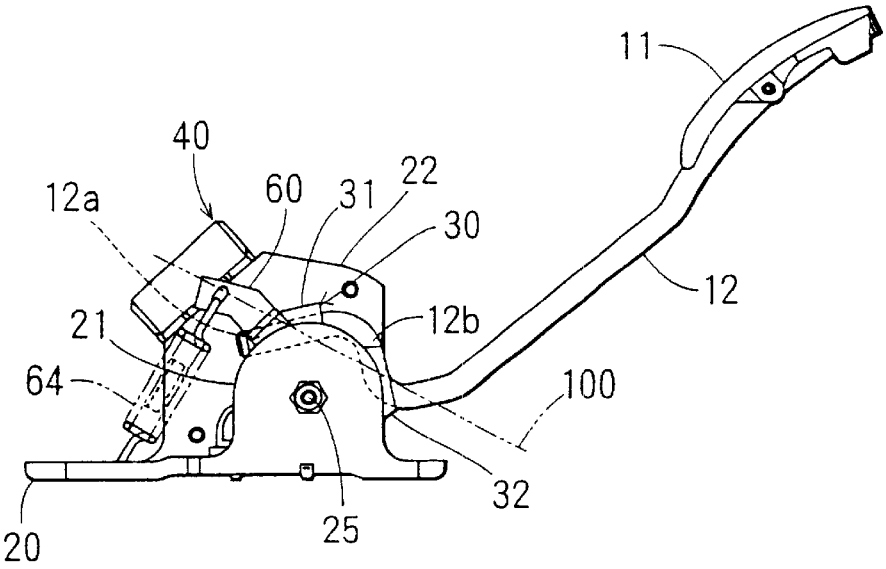
FIG. 5 is a side view showing the accelerator when being viewed from the arrow V in FIG. 1.

A support member 20 of the accelerator 10 is fixed to a vehicle frame using a fastening member such as a bolt so that the accelerator 10 is mounted on a vehicle. An acceleration pedal 11 through which a driver of the vehicle operates the accelerator 10 is attached to one end portion of a pedal arm 12. The other end portion of the pedal arm 12, opposite to the acceleration pedal 11, is attached to an acceleration rotor 30. When the driver operates (steps) the acceleration pedal 11, the stepping force is transmitted to the acceleration rotor 30 through the pedal arm 12, and the acceleration rotor 30 rotates. As shown in FIG. 5, the other end portion of the pedal arm 12 is bent twice opposite to each other by approximate right angle. Further, the other end portion of the pedal arm 12 has a top end part 12*a* and a bending part 12*b*, and pedal arm 12 is bent to cross with a virtual line 100 connecting both approximate centers of the top end part 12*a* and the bending part 12*b*. In the first embodiment, the virtual line 100 corresponds to a virtual line connecting both attachment positions at which the pedal arm 12 is attached to the acceleration rotor 30.

Figure 1:
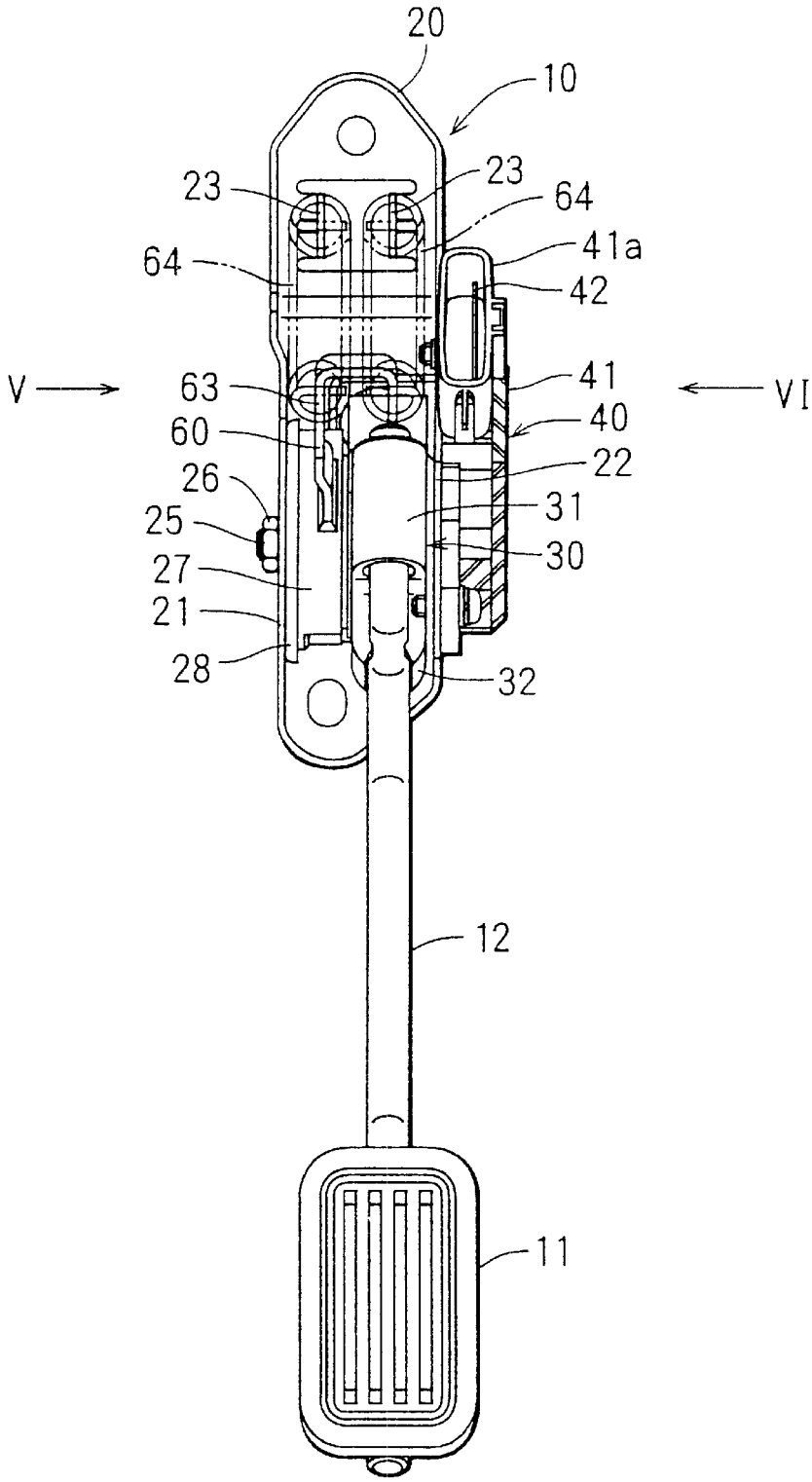
FIG. 1 is a plan view showing an accelerator according to a first preferred embodiment of the present invention.
Figure 3:
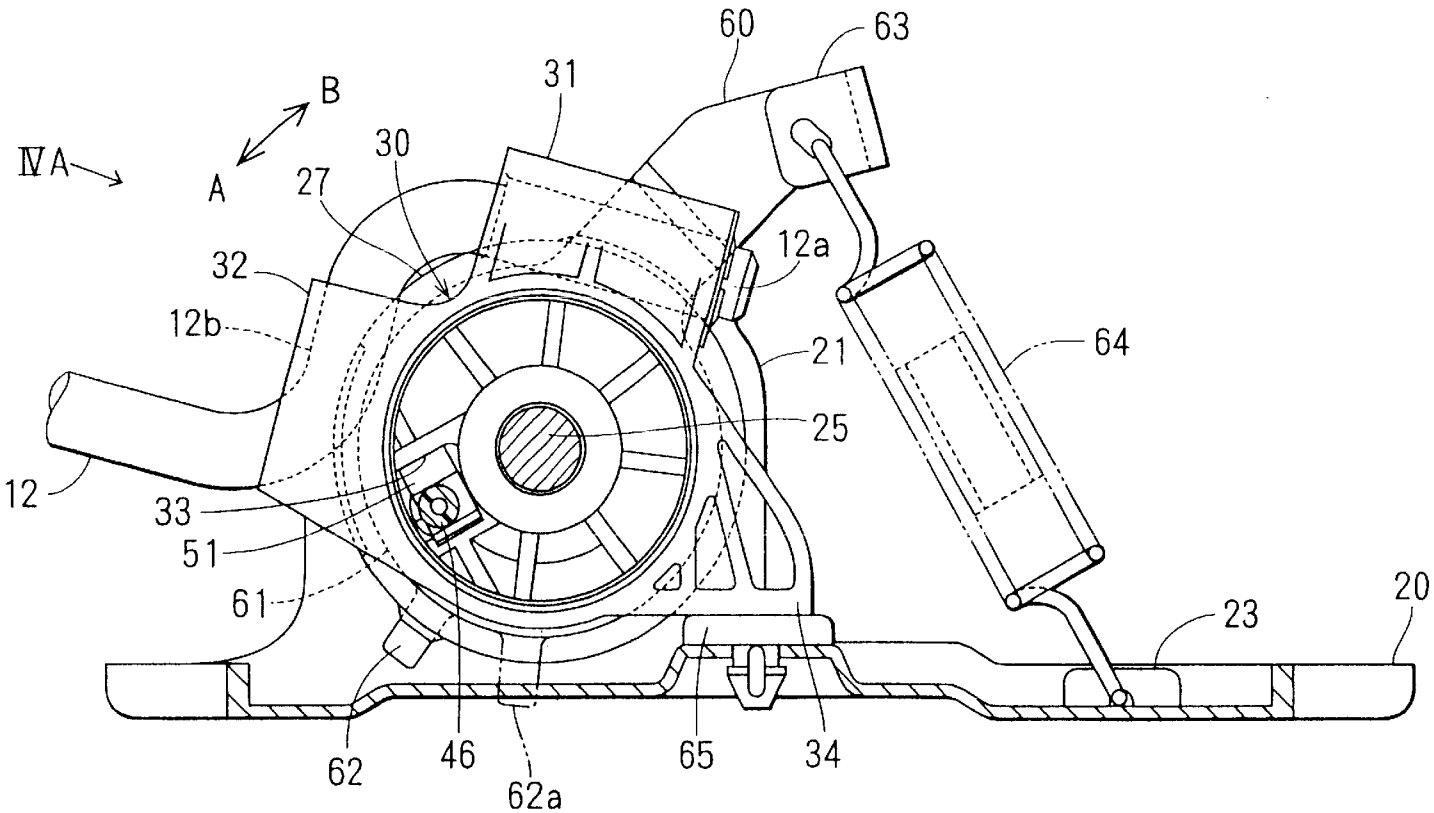
FIG. 3 is a cross-sectional view taken along line III—III in FIG. 2.

As shown in FIG. 1, a support shaft 25 is inserted into shaft receiving plates 21, 22 of the support member 20 to be fixed to the shaft receiving plates 21, 22 by a bolt 26. A lever rotor 27 is made of resin, and a circular plate 61 of a lever 60 is inserted into the lever rotor 27, as shown in FIG. 3. One end of a spring 64 is engaged with an arm portion 63 of the lever 60, and the other end of the spring 64 is engaged with an engagement member 23 of the support member 20. The spring 64 is disposed to bias the lever 60 in the direction B shown in FIG. 3. When the acceleration pedal 11 is not stepped, a stopper 34 provided in the acceleration rotor 30 contacts an engagement member 65 attached to the support member 20 to be engaged with the engagement member 65. When the driver steps the acceleration pedal opposite to spring force of the spring 64, the lever rotor 27 and the lever 60 rotate in the direction A shown in FIG. 3 together with the acceleration rotor 30. A claw 62 is provided in the circular plate 61 of the lever 60. When the claw 62 of the circular plate 61 rotates to the position 62*a* shown by the chain line, the claw 62 is engaged with an engagement portion of the support member 20.

Figure 2:
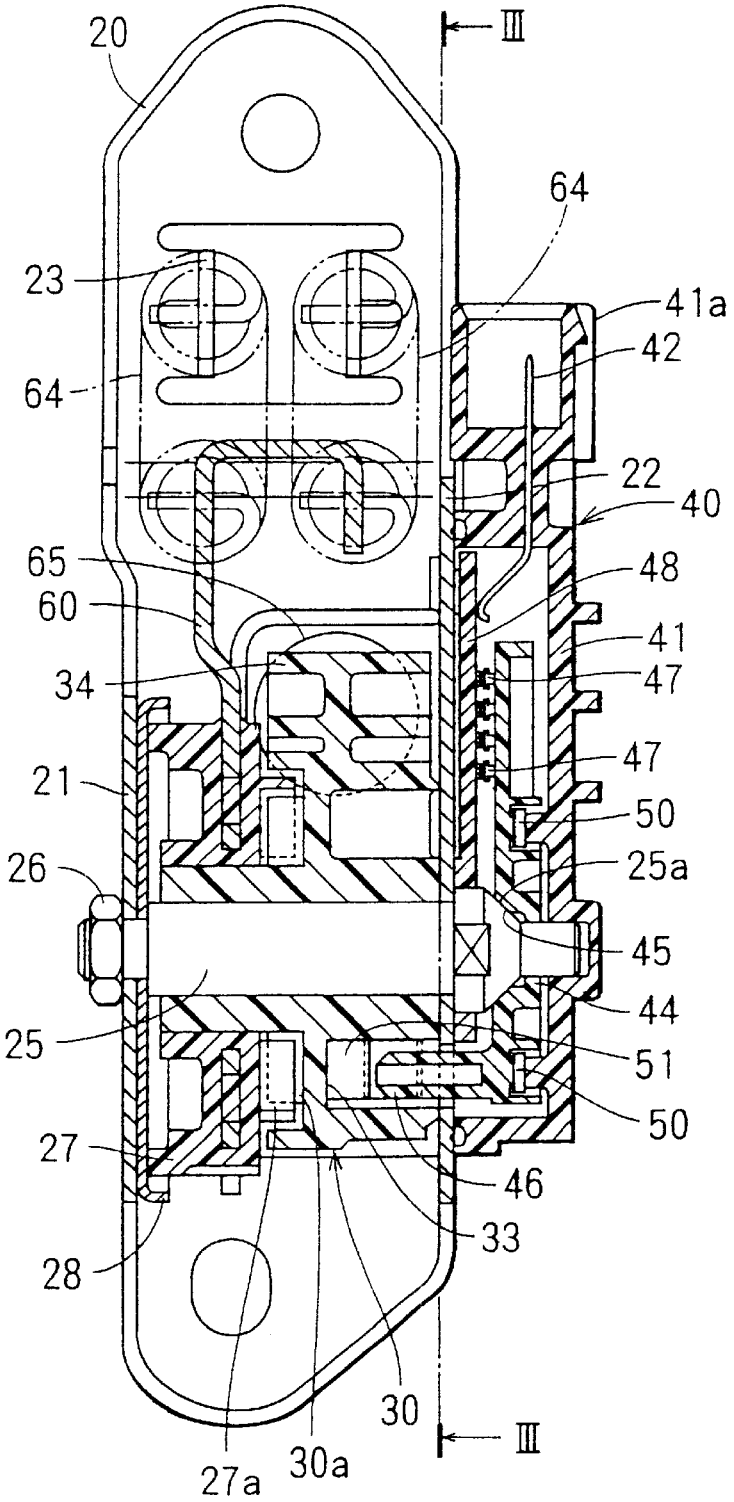
FIG. 2 is a sectional view showing the accelerator according to the first embodiment.

As shown in FIG. 2, bevel tooth portions 27*a*, 30*a* are provided in the lever rotor 27 and the acceleration rotor 30, respectively, to be opposite to each other. The bevel tooth portions 27*a*, 30*a* are engaged with each other so that the spring force of the spring 64 is received in a direction separating both the lever rotor 27 and the acceleration rotor 30 from each other. Further, even when the acceleration pedal 11 is stepped to opposite to the spring force of the spring 64, the bevel tooth portions 27*a*, 30*a* are engaged with each other so that a force for separating the lever rotor 27 and the acceleration rotor 30 is also applied thereto. A washer plate 28 is inserted between the lever rotor 27 and the shaft receiving plate 21 to reduce a sliding abrasion. Here, the washer plate 28 decreases the sliding abrasion between the lever rotor 27 and the shaft receiving plate 21.

Figure 4A:
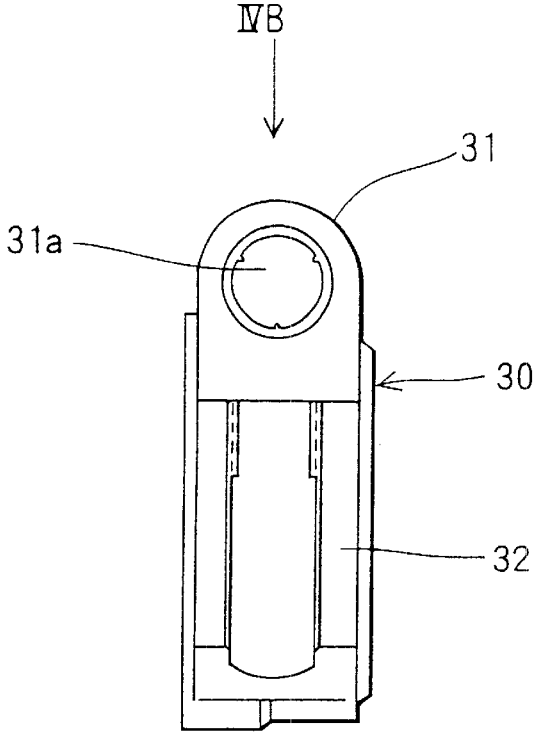
FIG. 4A is a side view showing a part of an acceleration rotor, when being viewed from the arrow IVA in FIG. 3.
Figure 4B:
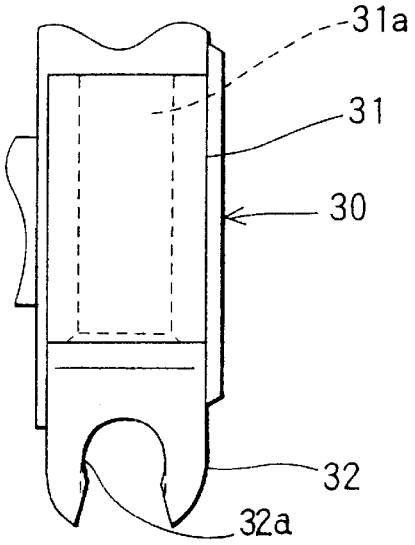
FIG. 4B is a view when being viewed from the arrow IVB in FIG. 4A.

The acceleration rotor 30 is integrally molded by resin, and is rotatably supported in the support shaft 25. As shown in FIGS. 3 and 5, the acceleration rotor 30 has a press-fitting portion 31 as a first attachment portion, and an insertion portion 32 as a second attachment portion. The press-fitting portion 31 and the insertion portion 32 are provided in an outer peripheral portion of the acceleration rotor 30 to form an approximate right angle between the press-fitting portion 31 and the insertion portion 32. The press-fitting portion 31 and the insertion portion 32 are formed to be separated from each other in a rotation direction of the acceleration rotor 30. As shown in FIG. 4A, a press-fitting hole 31*a* is provided in the press-fitting portion 31, and the top end part 12*a* of the pedal arm 12 is press-fitted into the press-fitting portion 31 without using a fastening member. As shown in FIG. 4B, the insertion portion 32 has a recess 32*a* formed into a C-shape in cross-section. The recess 32*a* has a narrowed dimension at an opening side. Therefore, when the bending part 12*b* of the pedal arm 12 is inserted into the recess 32*a* of the insertion portion 32, the bending part 12*b* is snap-fitted into the recess 32*a* of the insertion portion 32. In the first embodiment, the top end part 12*a* of the other end portion of the pedal arm 12 is press-fitted into the press-fitting portion 31 in the same direction as a direction where the bending part 12*b* thereof is inserted into the insertion portion 32.

Figure 6:
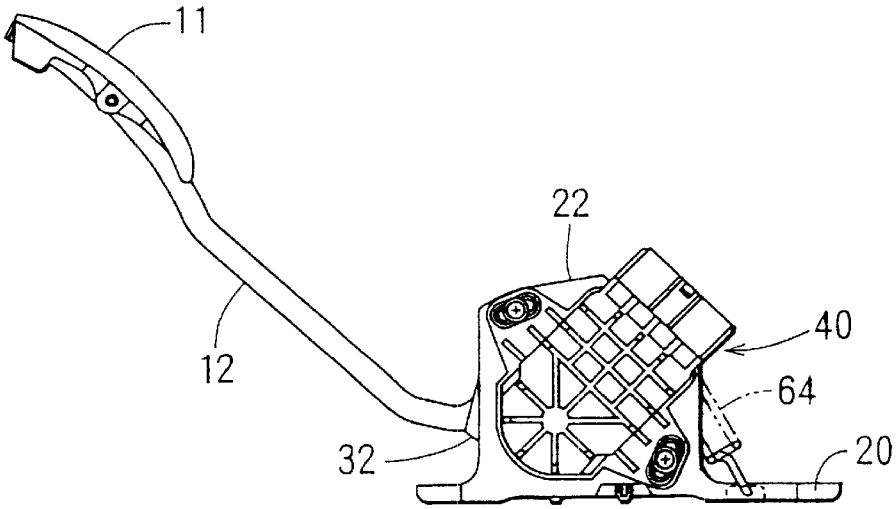
FIG. 6 is a side view showing the accelerator when being viewed from the arrow VI in FIG. 1.

As shown in FIGS. 1, 2 and 6, the acceleration opening degree sensor 40 is attached to the shaft receiving plate 22 of the support member 20 at a side opposite to the acceleration rotor 30. As shown in FIG. 2, the acceleration opening degree sensor 40 includes a sensor rotor 44, a contact portion 47 attached to the sensor rotor 44 and a base plate 48 to which a resistor is applied. The base plate 48 is fixed to the shaft receiving plate 22 at a side of the sensor rotor 44. A constant voltage of 5V is applied to the resistor applied on the base plate 48. A sliding position of the contact portion 47 relative to the resistor on the base plate 48 is changed in accordance with an acceleration operation amount, so that an output voltage value of the acceleration opening degree sensor 40 is changed. The output voltage value from the acceleration opening degree sensor 40 is input to the ECU (not shown), and an acceleration opening degree is detected.

Plural terminals 42 are embedded in a connector portion 41*a* provided in a cover 41 made of resin. The sensor rotor 44 is made of resin, and is rotatably supported in the support shaft 25. A plate spring 50 is disposed to bias the sensor rotor 44 toward the acceleration rotor 30 in an axial direction of the support shaft 25. By the spring force of the plate spring 50, a taper surface 45 formed on the sensor rotor 44 press-contacts a taper surface 25*a* provided on the support shaft 25 to slide on the taper surface 25*a*. A protrusion 46 is provided in the sensor rotor 44 at a position shifted from the support shaft 25. The protrusion 46 is inserted into a recess portion 33 formed in the acceleration rotor 30. A plate spring 51 is inserted into the recess portion 33 to have a holding portion for holding the protrusion 46. The holding portion of the plate spring 51 is bent and is formed into a U-shape in cross section. Because the protrusion 46 is held by the spring force of the plate spring 51 in a direction opposite to the rotation direction, the sensor rotor 44 is rotated with the rotation of the acceleration rotor 30. That is, it can prevent the acceleration rotor 30 from being shifted in the rotation direction, relative to the sensor rotor 44. A clearance is formed between the protrusion 46 and the plate spring 51 in the axial direction of the support shaft 25, and an opening of the plate spring 51 on a side of the protrusion 46 extends in a radial direction of the acceleration rotor 30. Accordingly, the acceleration rotor 30 can slide and shift with the plate spring 51 in the axial direction of the support shaft 25 and the radial direction of the acceleration rotor 30, relative to the sensor rotor 44.

Next, operation of the accelerator 10 will be now described. When a stepping amount of the acceleration pedal 11 is adjusted by a driver, the acceleration rotor 30 rotates around the support shaft 25 through the pedal arm 12. Because the bevel tooth portion 27*a* of the lever rotor 27 is engaged with the bevel tooth portion 30*a* of the acceleration rotor 30, the rotation of the acceleration rotor 30 due to operation of the acceleration pedal 11 is transmitted to the lever rotor 27, and the spring force of the spring 64 is transmitted from the lever rotor 27 to the acceleration pedal 11.

The bevel tooth portions 27*a*, 30*a* of the lever rotor 27 and the acceleration rotor 30 are engaged, so that force in a direction separating both the lever rotor 27 and the acceleration rotor 30 from each other is received. When the acceleration pedal 11 steps, a sliding resistance between both the rotors 27, 30 and both the shaft receiving plates 21, 22 is added in a direction opposite to the stepping force of the acceleration pedal 11. on the other hand, when the acceleration pedal 11 returns from the stepping state, a sliding resistance opposite to the spring force of the spring 64 is added. The operation force in a returning direction opposite to the stepping direction while the acceleration pedal 11 steps is larger than the operation force in the returning direction while the acceleration pedal returns from the stepping state. That is, hysteresis is set between the stepping amount of the acceleration pedal 11 and the force applied to the acceleration pedal 11 in the returning direction. Therefore, the acceleration pedal 11 can be readily held at a certain position.

Because the protrusion 46 of the sensor rotor 44 is fitted into the recess portion 33 of the acceleration rotor 30, the sensor rotor 44 rotates with the acceleration rotor 30. When a rotation angle of the sensor rotor 44 changes, the position of the contact portion 47 contacting the resistor applied on the base plate 48 is displaced, and the output voltage value from the acceleration opening degree sensor 40 is changed. By detecting the voltage value, the acceleration opening degree of the accelerator 10 can be detected.

Because the direction operating the acceleration pedal 11 by the driver is generally changed, a force may be applied to the pedal arm 12 in a direction where the pedal arm 12 rotates around a rotation axis different from the support shaft 25. However, in the first embodiment, as shown in FIG. 5, the other end portion of the pedal arm 12 is bent, so that the virtual line 100, connecting the positions at which the pedal arm 12 is attached to the press-fitting portion 31 and the insertion portion 32, crosses with the pedal arm 12. Thus, even when a force for rotating the pedal arm 12 around a rotation axis different from the support shaft 25 is applied, the pedal arm 12 does not rotate. That is, unless the top end part 12*a* of the pedal arm 12 is removed from the press-fitting portion 31 or the bending part 12*b* is removed from the insertion portion 32, the pedal arm 12 does not rotate around a rotation axis different from the support shaft 25. Only when a force is applied to the pedal arm 12 in an opposite direction opposite to an assembling direction of the pedal arm 12 to the acceleration rotor 30, the pedal arm 12 removes from the acceleration rotor 30. However, in a general operation of the acceleration pedal 11, the force in this opposite direction is not added. In the first embodiment, the top end part 12*a* of the pedal arm 12 is press-fitted to the press-fitting portion 31 of the acceleration rotor 30, and the bending part 12*b* of the pedal arm 12 is inserted into the insertion portion 32. Therefore, it can prevent the pedal arm 12 from being removed from the acceleration rotor 30, and can prevent the pedal arm 12 from rotating around a rotation axis different from the support shaft 25.

Further, because the pedal arm 12 is attached to the acceleration rotor 30 at both attachment positions of the press-fitting portion 31 and the insertion portion 32, a force adding from the pedal arm 12 to the acceleration rotor 30 is dispersed. Accordingly, when the force from the pedal arm 12 is added to the acceleration rotor 30, it can prevent the acceleration rotor 30 made of resin from being damaged.

In the first embodiment, the top end part 12*a* of the pedal arm 12 is press-fitted into the press-fitting portion 31, and the bending part 12*b* of the pedal arm 12 is snap-fitted into the insertion portion 32, so that the pedal arm 12 is attached to the acceleration rotor 30 without using a fastening member. However, only when the pedal arm 12 is attached to the acceleration rotor 30 at attachment positions separated in the rotation direction of the acceleration rotor 30, the attachment structure for attaching the pedal arm 12 to the acceleration rotor 30 can be arbitrarily changed. In the first embodiment, the other end portion of the pedal arm 12, for attaching the pedal arm 12 to the acceleration rotor 30, is bent by the approximate right angle. However, the other end portion of the pedal arm 12 may be bent in a circular arc like. In the first embodiment, the other end portion of the pedal arm 12 is bent, so that the virtual line connecting the attachment positions, where the top end part 12*a* and the bending part 12*b* of the pedal arm 12 are attached to the attachment portions 31, 32 of the acceleration rotor 30, crosses with the pedal arm 12 at least at one of the attachment positions. Therefore, it can accurately prevent the pedal arm 12 from being rotated around a rotation axis different from the supporting shaft 25.

Further, in the first embodiment, because the lever rotor 27 and the acceleration rotor 30 are made of resin, the lever rotor 27 and the acceleration rotor 30 having the bevel tooth portions 27*a*, 30*a* can be readily formed.

A second preferred embodiment of the present invention will be now described with reference to FIG. 7. In the above-described first embodiment, the pedal arm 12 is attached to the acceleration rotor 30 at two attachment positions of the acceleration rotor 30. In the second embodiment, a pedal arm 70 is attached to tan acceleration rotor 80 at three attachment positions. In the second embodiment, the other parts are similar to those of the above-described first embodiment.

Figure 7:
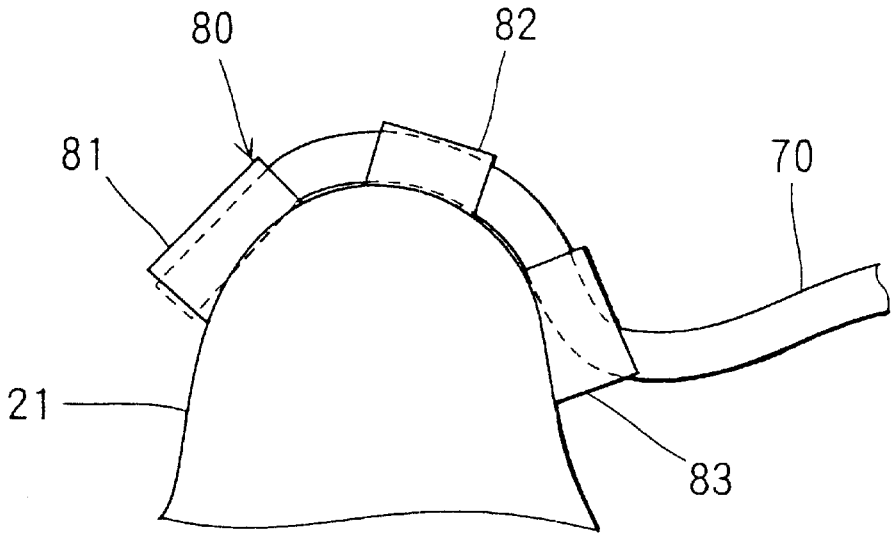
FIG. 7 is a schematic diagram showing an acceleration rotor and a pedal arm of an accelerator, according to a second preferred embodiment of the present invention.

As shown in FIG. 7, the pedal arm 70 is attached to the acceleration rotor 80 at three attachment positions of the acceleration rotor 80. For example, a press-fitting portion 81, an insertion portion 82 and an insertion portion 83 are provided in the acceleration rotor 80 separately from each other in the rotation direction (circumferential direction) of the acceleration rotor 80. The acceleration rotor 80 is made of resin. In the second embodiment, a virtual line connecting both approximate center portions of any two attachment positions crosses with the pedal arm 70 at the any two attachment positions.

One end portion of the pedal arm 70 is connected to the acceleration pedal 11, and the other end portion of the pedal arm 70 is attached to the acceleration rotor 80. The other end portion of the pedal arm 70 has a top end part formed into a straight line like, and has a circular arc portion connected to the top end part. The straight top end part of the other end portion of the pedal arm 70 is press-fitted into the press-fitting portion 81, and the circular arc portion of the other end portion of the pedal arm 70 are snap-fitted into the insertion portions 82, 83, respectively. A fitting direction for press-fitting the pedal arm 70 into the press-fitting portion 81 is set to the same as an insertion direction for inserting the pedal arm 70 into the insertion portions 82, 83.

In the above-described second embodiment, the other end portion of the pedal arm 70 is bent relative to the three attachment portions 81–83 of the acceleration rotor 80 so that the virtual line connecting both approximate center portions of any two attachment portions crosses with the pedal arm 70 at the any two attachment portions. Therefore, even when force is applied to the pedal arm 70 in a direction where pedal arm 70 rotates around a rotation axis different from the support shaft 25, the pedal arm 70 does not rotate. Accordingly, the effect similar to that of the first embodiment can be obtained. In the second embodiment, the other end portion of the pedal arm 70 can be bent to be attached to the three attachment portions 81–83 of the acceleration rotor 80 so that the virtual line connecting both approximate center portions of any two attachment portions crosses with the pedal arm 70 at least at one of the any two attachment portions.

Further, because the fitting direction for press-fitting the pedal arm 70 into the press-fitting portion 81 of the acceleration rotor 80 is the same as the insertion direction for inserting the pedal arm 70 into the insertion portions 82, 83 of the acceleration rotor 80, the pedal arm 70 can be readily attached to the acceleration rotor 80.

Although the present invention has been fully described in connection with the preferred embodiments thereof with reference to the accompanying drawings, it is to be noted that various changes and modifications will become apparent to those skilled in the art.

For example, in the above-described first and second embodiments, the pedal arm 12, 70 is attached to the acceleration rotor 30, 80, at the two or three attachment positions. However, four or more attachment positions can be set in the acceleration rotor 30, 80. Further, the shape of the acceleration rotor 30, 80 can be arbitrarily changed. In this case, plural attachment portions can be provided in a curve portion of the acceleration rotor 30 to be separated from each other in the rotation direction of the acceleration rotor 30, and the other end portion of the pedal arm 12 is bent to be attached to the plural attachment portions so that the pedal arm 12 rotates only around the rotation shaft 25 of the acceleration rotor 30.

In the above-described first embodiment, the acceleration rotor 30 and the sensor rotor 44 are attached to be rotatable on the common support shaft 25. Therefore, the size of the accelerator 10 can be reduced, the number of components of the accelerator 10 can be reduced, and assembling performance of the accelerator 10 is improved. Further, in this case, because a change state of the acceleration rotor 30 corresponds to that of the sensor rotor 44 which rotates with the rotation of the acceleration rotor 30, the acceleration opening degree of the accelerator 10 can be accurately set. However, in the present invention, the acceleration rotor 30 and the sensor rotor 44 may be rotatably supported by different support shafts.

In the above-described first embodiment, the present invention is typically applied to an acceleration device where the acceleration opening degree sensor 40 is provided in the accelerator 10 and the throttle opening degree is controlled by detection signals from the acceleration opening degree sensor 40. However, the present invention can be applied to an acceleration device where the throttle opening degree is controlled by connecting an accelerator and a throttle device by a wire.

Such changes and modifications are to be understood as being within the scope of the present invention as defined by the appended claims.

What is claimed is:

1. An accelerator comprising:

an acceleration pedal for performing an acceleration operation;

a pedal arm having one end portion connected to the acceleration pedal;

an acceleration rotor made of resin, the acceleration rotor having plural attachment portions, separated from each other in a rotation direction of the acceleration rotor, to which the other end portion of the pedal arm is attached;

a support member which rotatably supports the acceleration rotor; and a biasing member which biases the acceleration rotor in a direction opposite to a stepping direction of the acceleration pedal, wherein the other end portion of the pedal arm is bent to be attached to the plural attachment portions in such a manner that a virtual line connecting both approximate centers of any two attachment portions crosses with the pedal arm at least at one of the any two attachment portions.

2. The accelerator according to claim 1, wherein:

the plural attachment portions at least have a first attachment part to which a top end part of the other end portion of the pedal arm is attached, and a second attachment part different from the first attachment part; and the top end part of the other end portion of the pedal arm is press-fitted into the first attachment part.

3. The accelerator according to claim 2, wherein:

the other end portion of the pedal arm has an insertion part at a position different from the top end part; and the insertion part of the other end portion of the pedal arm is inserted into the second attachment part of the acceleration rotor.

4. The accelerator according to claim 3, wherein the first attachment part and the second attachment part are disposed in such a manner that a press-fitting direction for press-fitting the top end part of the other end portion of the pedal arm into the first attachment part is the same as an insertion direction for inserting the insertion part of the other end portion of the pedal arm into the second attachment part.

5. The accelerator according to claim 1, further comprising an acceleration sensor for detecting a rotation angle position of the acceleration rotor.

6. The accelerator according to claim 5, wherein the acceleration sensor has a sensor rotor which is disposed to be rotatable with a rotation of the acceleration rotor.

7. The accelerator according to claim 6, wherein the sensor rotor and the acceleration rotor rotate around a common single rotation shaft.

8. The accelerator according to claim 1, wherein:

the acceleration rotor is disposed to rotate around a rotation shaft; and the other end portion of the pedal arm is attached to the plural attachment portions of the acceleration rotor to be rotated only around the rotation shaft.

9. The accelerator according to claim 3, wherein:

the first attachment part has therein a hole into which the top end part of the other end portion of the pedal arm is press-fitted to be engaged; and the second attachment part has a recess into which the insertion part of the other end portion of the pedal arm is snap-fitted to be engaged.

10. An accelerator having an acceleration pedal for performing an acceleration operation, the accelerator comprising:

a pedal arm having one end portion connected to the acceleration pedal;

an acceleration rotor made of resin, the acceleration rotor having plural attachment portions, separated from each other in a rotation direction of the acceleration rotor, to which the other end portion of the pedal arm is attached; and a support member which rotatably supports the acceleration rotor, wherein:

the acceleration rotor has a curve portion bent in the rotation direction;

the attachment portions are provided in the curve portion; and the other end portion of the pedal arm is bent to be attached to the plural attachment portions in such a manner that the acceleration rotor rotates only around a rotation shaft of the acceleration rotor.

11. The accelerator according to claim 10, wherein:

the plural attachment portions at least have a first attachment part to which a top end part of the other end portion of the pedal arm is attached, and a second attachment part different from the first attachment part; and the top end part of the other end portion of the pedal arm is press-fitted into the first attachment part.

12. The accelerator according to claim 11, wherein:

the other end portion of the pedal arm has an insertion part at a position different from the top end part; and the insertion portion of the other end portion of the pedal arm is inserted into the second attachment part of the acceleration rotor.

13. The accelerator according to claim 12, wherein the first attachment part and the second attachment part are disposed in such a manner that a press-fitting direction for press-fitting the top end part of the pedal arm into the first attachment part is the same as an insertion direction for inserting the insertion part of the pedal arm into the second attachment part.

14. The accelerator according to claim 12, wherein:

the first attachment part has therein a hole into which the top end part of the other end portion of the pedal panel is press-fitted to be engaged; and the second attachment part has a recess into which the insertion portion of the other end portion of the pedal arm is snap-fitted to be engaged.

15. The accelerator according to claim 10, wherein the acceleration rotor is integrally molded by the resin.

16. An accelerator assembly comprising:

an accelerator pedal arm having a first operator actuated proximate end and a second bent distal end; and a rotatably mounted accelerator rotor made of resin and having plural attachment portions angularly spaced about an axis of rotation and adapted for connection to respective spaced-apart portions of said bent distal end of the accelerator pedal arm, wherein a virtual line connecting an approximate center of any two attachment portions crosses the edges of the pedal arm extending therebetween.

17. An accelerator assembly as in claim 16 wherein a most distal portion of the pedal arm is press-fitted by linear movement along its axis into a mating attachment portion of the rotor while, simultaneously, at least one other portion of the bent distal end is snap-fitted transversely into a mating attachment portion of the rotor.

18. An accelerator assembly as in claim 17 further comprising a rotation sensor rotor mounted for rotation about the same said axis of rotation as used for the accelerator rotor.

* * * * *